US005833555A

United States Patent [19]

Jer-Min

[11] Patent Number: 5,833,555

[45] Date of Patent: Nov. 10, 1998

[54] GRAVITATIONALLY RESTORED BALL PRACTICE DEVICE

[76] Inventor: Liaw Jer-Min, P.O. Box 55-846, Taipei, Taiwan

[21] Appl. No.: 923,825

[22] Filed: Sep. 4, 1997

[51] Int. Cl.[6] ..... A63B 69/40

[52] U.S. Cl. ..... 473/429; 473/145

[58] Field of Search ..... 473/423, 429, 473/430, 437; 273/145, 149

[56] References Cited

U.S. PATENT DOCUMENTS

| | | | |
|---|---|---|---|
| 1,529,933 | 3/1925 | Stokor | 473/145 |
| 3,118,670 | 1/1964 | Smith | 473/429 |
| 3,472,075 | 10/1969 | Oppenheimer | 473/145 |
| 3,647,219 | 3/1972 | Ravatt | 473/145 |
| 5,133,549 | 7/1992 | Vasquez | 473/429 |
| 5,467,979 | 11/1995 | Zarate | 473/429 |

*Primary Examiner*—Theatrice Brown

[57] ABSTRACT

A ball practice device including a base secured with a plurality of cushioning pads on the base, a telescopic post erected on the base having an elbow tube telescopically held on the post, and a practice ball and a counterweight ball having a weight slightly heavier than that of the practice ball with the two balls generally symmetrically disposed on opposite ends of a T-shaped connector which is rotatably engageable with a horizontal tube portion of the elbow tube, with the practice ball and the counterweight ball linearly aligned to be perpendicular to the horizontal tube portion of the elbow tube, whereby upon hitting of the practice ball, the practice ball and the counter weight ball will be rotated about the horizontal tube portion, and when stopped, the practice ball will be automatically restored upwardly ready for next hitting while the counterweight ball is gravitationally pendent downwardy.

7 Claims, 3 Drawing Sheets

FIG. 3
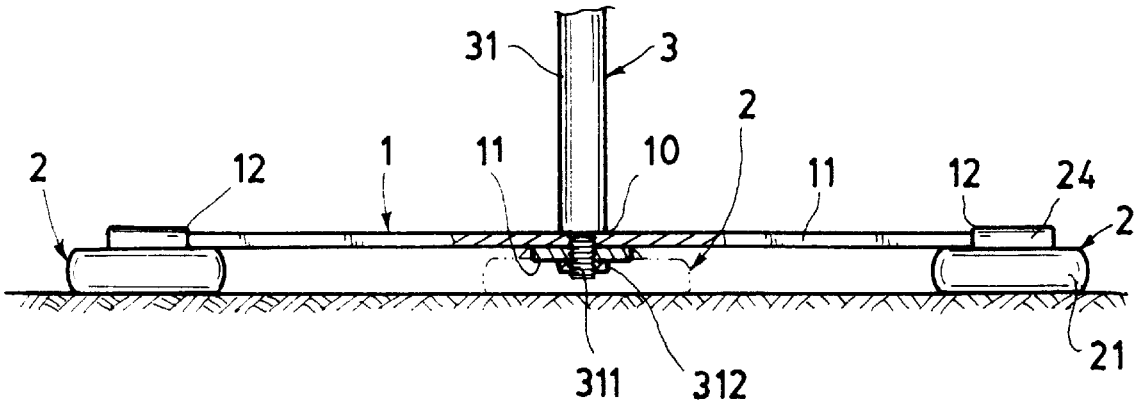
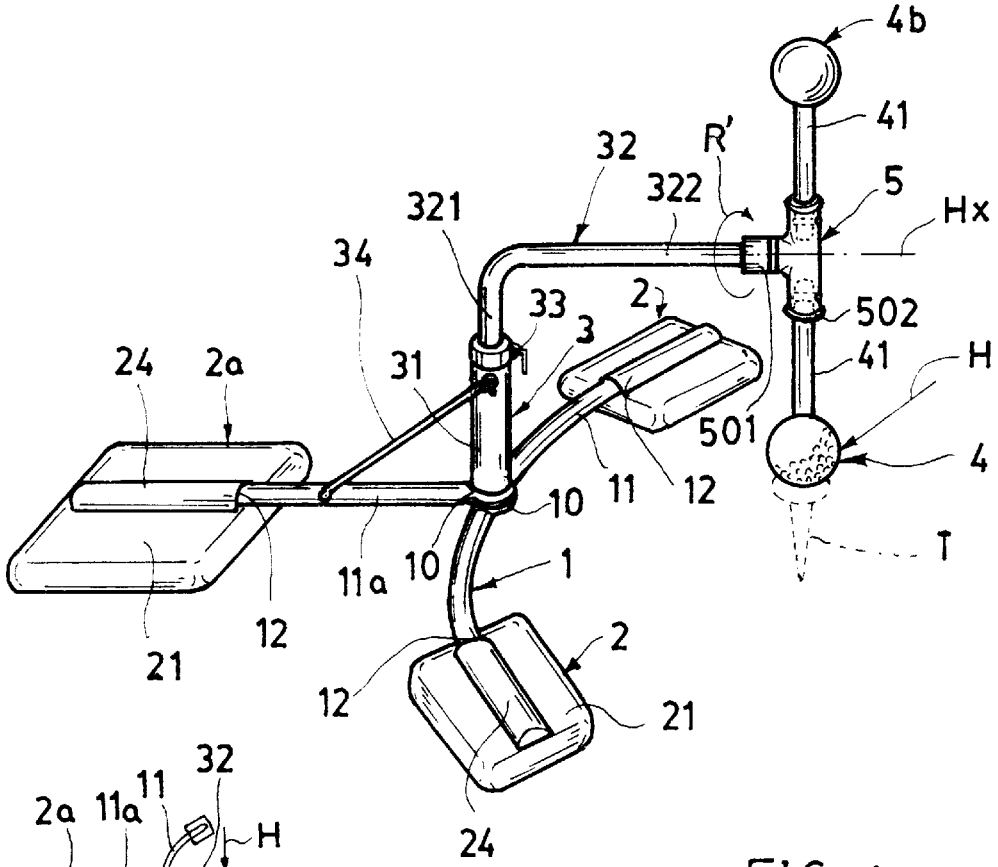
FIG. 4
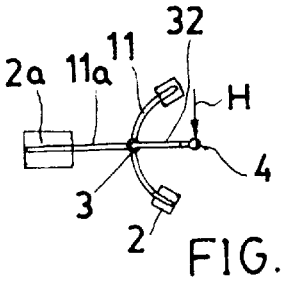
FIG. 5

GRAVITATIONALLY RESTORED BALL PRACTICE DEVICE

BACKGROUND OF THE INVENTION

This application is an improvement based upon an earlier U.S. patent application (hereinafter called as "Prior Art") of Ser. No. 08/638,952, filed on: Apr. 25, 1996 which is now allowed and paid the Issue fee, by the same inventor of this application.

The prior art discloses a shock-absorbable ball practice device having a pair of balls symmetrically fixed on opposite ends of a T connector rotatably mounted on a central post which is supported by a plurality of leg members each leg member jacketed in a cushioning pad for absorbing the vibrational shock caused when hitting the ball.

However, the prior art has the following drawbacks:

1. The two balls 4 symmetrically fixed on the opposite ends of the central post 3, after being hit such as by a baseball bat, will be free rotated and will not stop at a fixed position after stopping the rotation of the balls. The player should always adjust or move the ball to a specific starting position, causing inconvenience for the player.
2. For matching a height of a tall players the post 3 should be greatly extended upwardly to a higher position, simultaneously raising the specific gravity of the ball practice device to cause unstable serious vibration of the device even provided with the shock-absorbing pads 2, thereby influencing a smooth ball practice.
3. It is not suitable for use in a golf practice since the two balls 4 on the two arms 5, once being lowered to approximate the ground surface for simulating a golf ball, will be obstructed by the cushioning pads 2 when the balls are rotated.

The present inventor has found the drawbacks of his earlier invention and invented the present ball practice device of which the ball will be automatically restored by gravitational force.

SUMMARY OF THE INVENTION

The object of the present invention is to provide a ball practice device including a base secured with a plurality of cushioning pads on the base, a telescopic post erected on the base having an elbow tube telescopically held on the post, and a practice ball and a counterweight ball having a weight slightly heavier than that of the practice ball with the two balls generally symmetrically disposed on opposite ends of a T-shaped connector which is rotatably engageable with a horizontal tube portion of the elbow tube, with the practice ball and the counterweight ball linearly aligned to be perpendicular to the horizontal tube portion of the elbow tube, whereby upon hitting of the practice ball, the practice ball and the counterweight ball will be rotated about the horizontal tube portion, and when stopped, the practice ball will be automatically restored upwardly ready for next hitting while the counterweight ball is gravitationally pendent downwardly.

BRIEF DESCRIPTION OF THE DRAWING

FIG. 3 is a partial sectional drawing of the base of the present invention.

FIG. 4 is an illustration of the present invention for practicing a golf ball.

FIG. 5 is a simplified top-view illustration of the present invention when viewed from FIG. 4.

DETAILED DESCRIPTION

Figure 1:
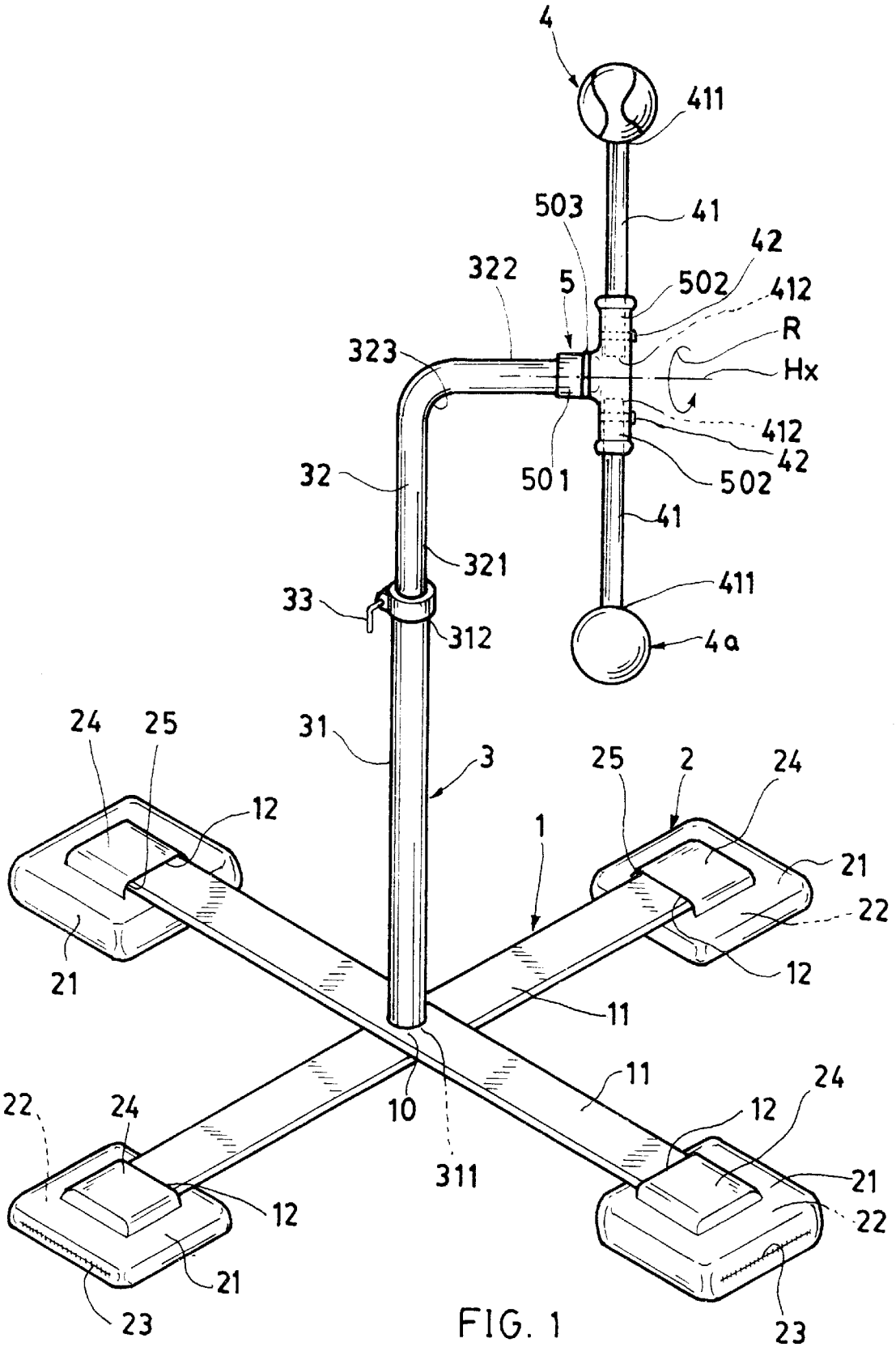
FIG. 1 is a perspective view of the present invention adapted for practicing a baseball.

As shown in FIG. 1, the present invention comprises: a base 1, a plurality of shock absorbing members 2 secured to the base 1, a telescopic post 3 erected on the base 1, a ball 4 for hitting practice and a counterweight ball 4*a* symmetrically disposed on opposite ends of a T-shaped connector 5 connected on an elbow tube 32 telescopically held on the post 3.

The base 1 includes a plurality of (or two ) leg members 11 crossing each other as shown in FIG. 1, or branched from the central telescopic post 3, or radially diverging outwardly from the central telescopic post 3, each leg member 11 having an end portion 12 secured with each shock absorbing member 2. The telescopic post 3 is telescopically erected on a central portion 10 of each leg member 11 of the base 1.

Even though the leg member 11 as shown in FIG. 1 is an elongate plate, the leg member 11 may be modified as a rod, a tube, a bar, or other structures, not limited in the present invention.

The base 1 of the present invention may also be branched, bifurcated, trifurcated from a central base plate (not shown) having the telescopic post 3 erected on the central base plate, not limited in the present invention.

The leg members 11 may be secured with the post 3 by any mechanical joining methods, or may even be integrally formed on the bottom of the post 3.

Each shock absorbing member 2 includes: a cushioning pad 21 which may be a sandbag filled with fillers 22 such as sand, a fastener 23 which may be a zipper fastener for fastening a bag opening formed in the pad 21 for filling filler 22 into the pad 21 through the bag opening which is closed by the fastener 23, and a sleeve portion 24 formed on a top surface of the pad 21 having a socket 25 recessed in the sleeve portion 24 for engaging an end portion 13 of each leg member 12 of the base 1.

Each shock absorbing member 2 is detachably secured to the leg member 12 of the base 1 for easier assembler and maintenance of the present invention.

The telescopic post 3 includes: a lower tube 31 vertically mounted on the base 1, and an elbow tube 32 telescopically held in the lower tube 31 with the elbow tube 32 adjustably lockable on or above the lower tube 31 by a locking means 33 provided at the top portion 312 of the lower tube 31, whereby upon a fastening of the locking means 33, the elbow tube 32 may be upwardly extended and stably positioned above the lower tube 31 as locked by the locking means 33 and upon a withdrawal of the elbow tube 32 from the lower tube 31, the elbow tube 32 may be disassembled or detached from the lower tube 31 for breakdown for handling or storage. The locking means 33 may be modified with a plurality of diversified designs for adjusting the extended height of the telescopic post 3, not limited in the present invention.

The lower tube 31 has a bottom tube portion 311 formed with male-threaded portion for passing through a central hole formed in a central portion 10 of each leg member 11 of the base 1, with a nut 312 engageable with the male-threaded portion 311 of the lower tube 31 for fastening the leg members 11 with the lower tube 31 of the post 3 as shown in FIG. 3.

The elbow tube 32 includes: a vertical tube portion 321 adjustably secured on the lower tube 31 of the post 3; and a horizontal tube portion 322 perpendicular to the vertical tube portion 321 with a right angle 323, and secured with the T-shaped connector 5 for connecting the ball 4 and the counterweight ball 4*a*.

Figures 2, 2A:
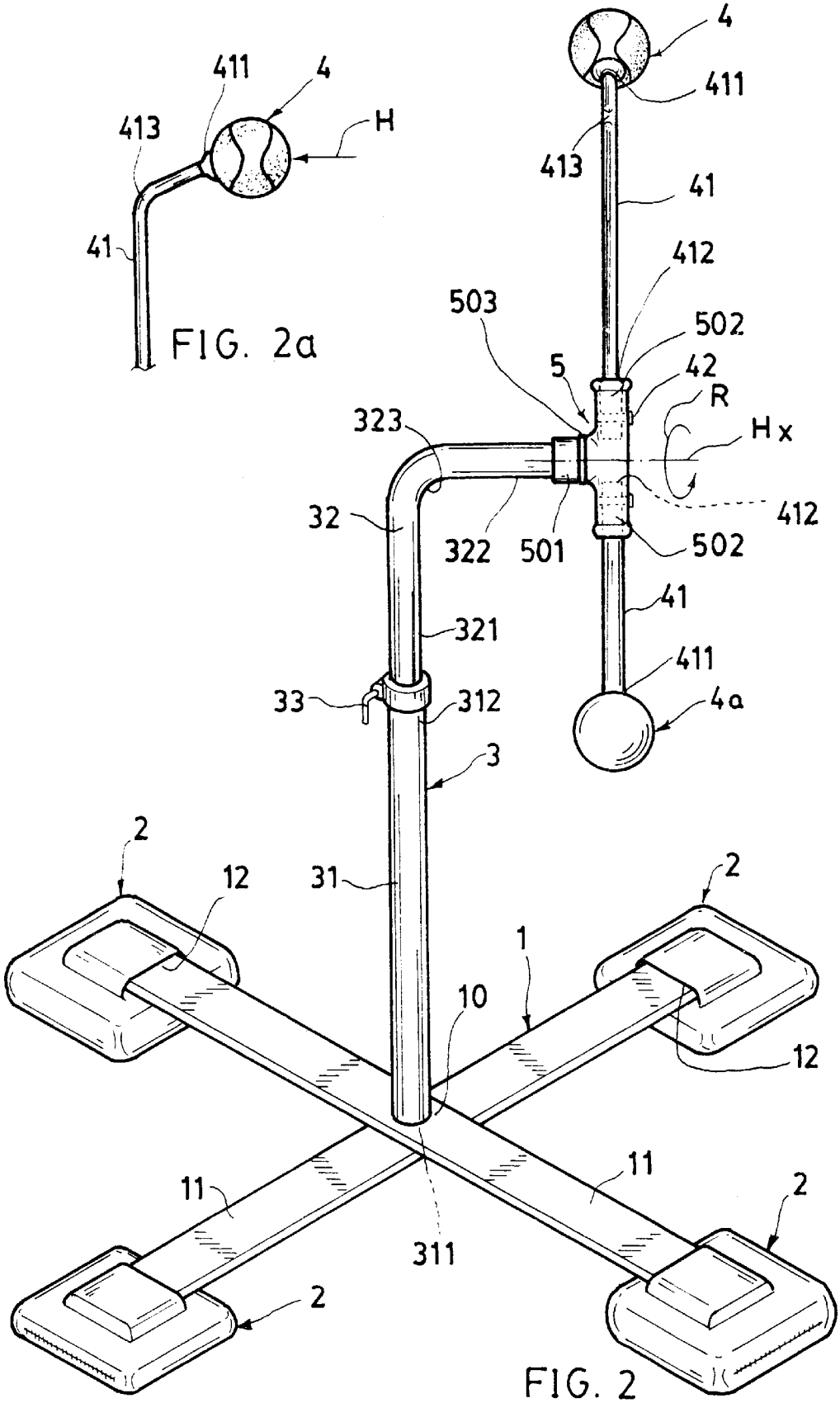
FIG. 2 is an illustration of the present invention for practicing a tennis ball.
FIG. 2*a* is a side view of the tennis ball as viewed from FIG. 2.

The ball 4 as shown in FIG. 1 is a baseball which is linked to the connector 5 by an upper link 41, while the ball 4 is a tennis ball as shown in FIG. 2.

For preventing damage of a tennis racket when hitting (H) the ball 4 as shown in FIG. 2*a*, the link 41 should be bent outwardly at its outer portion 413 adjacent to the outermost end portion 411 of the link 41.

The ball 4 is connected to a free end 411 of the link 41 of which a fixed end 412 is secured to the connector 5 by a screw 42 as shown in FIG. 1.

The counterweight ball 4*a* has a weight slightly larger than that of the ball 4 such as by increasing the density of the counterweight ball 4*a* during its molding process, or by adding heavy core (not shown) in the central portion of the counterweight ball 4*a*. The heavier weight of the counterweight ball 4*a* will be gravitationally pendent to automatically restore the ball 4 upwardly at an upright position as shown in FIG. 1 ready for hitting purpose.

The counterweight ball 4*a* is also secured to the connector 5 by a lower link 41. The ball 4 and the counterweight ball 4*a* are generally linearly aligned to be perpendicular to the horizontal tube portion 322 of the elbow tube 32 of the telescopic post 3.

The two links 41, 41 for respectively connecting the ball 4 and the counterweight ball 4*a* are equal in length for a dynamic balancing when hitting the ball 4 to rotate (R) the balls 4, 4*a* and the links 41, 41 about a horizontal axis Hx defined at a longitudinal center of the horizontal tube portion 322 of the post 3.

The T-shaped connector 5 includes: a horizontal adapter 501 fixed at an outer portion of the horizontal tube portion 322 of the elbow tube 32 of the post 3, a pair of vertical adapters 502 disposed on two opposite sides of the horizontal adapter 501 to be perpendicular to the horizontal adapter 501 with the pair of vertical adapters 502 rotatably connected with the horizontal adapter 501 by a bearing 503 for rotatably securing the pair of vertical adapters 502 about the horizontal adapter 501 and the horizontal tube portion 322 of the elbow tube 32 of the post 3 for rotating the ball 4 about a horizontal axis Hx defined at the center of the horizontal tube portion 322.

Since the ball 4 is connected to the horizontal tube portion 322 of the elbow tube 32 which is bent from a vertical axis of the post 3, the specific gravity of the tube 32 is lowered to thereby decrease the vibrational shock for enhancing a stable ball practice.

After stopping the rotation (R) of the balls 4, 4*a* and the links 41, 41 about the axis Hx, the counterweight ball 4*a* will be gravitationally pendent and the ball 4 is thus automatically restored upwardly to be positioned at an upper position ready for a next covenient hitting, thereby being superior to the prior art with the automatically gravitational restoring as taught by this application.

The lower link 41 has its lower end 411 connected with the counterweight ball 4*a* and has an upper end 412 secured to one vertical adapter 502 by a screw 42 as shown in FIG. 1.

By shortening the length or height of the tubes 31, 32 of the present invention, the present invention may be modified as shown in FIGS. 4, 5 for practicing hitting of golf ball 4.

The counterweight ball 4*b* as shown in FIG. 4 should be slightly lighter than that of the golf ball 4 since the golf ball 4 should be gravitationally pendent, after stopping the rotation (R') of the balls 4, 4*b*, to be positioned at a lower position near the ground surface to simulate a golf ball which is placed on a tee (T) as shown in dotted line of FIG. 4. So, this application is also suitable for practicing golf ball because the ball 4 can be pendently lowered by adjusting the height of the post 3 or the length of the link 41.

The horizontal tube portion 322 of the elbow tube 32 is horizontally extended to projectively exceed the shock absorbing members 2, 2 to prevent the attack of the ball on the cushioning pads 21, 21 when hit by a golf club.

In order to help stabilize the post 3 and the relevant elements of the present invention, a long leg member 11*a* is made longer and the cushioning pad 21 of the shock absorbing member 2*a* also made bigger for filling much sand for increasing the stability of the post 3 and the whole ball practice device. A reinforcing link 34 is provided to firmly secure the post 3 to the longer leg member 11*a* for enhancing the stability of such a golf ball practice device as shown in FIG. 4.

From a top view (FIG. 5) of the golf ball practice device (FIG. 4), the base 1 may be formed as trifurcated leg members 11, 11*a* to be generally "Y" shaped. One leg member 11 is formed as a bifurcated (arcuate) bar, while the elongate leg member 11*a* serves as a straight bar connected with the bifurcated bar to form the "Y" shape, allowing the golf ball 4 to be pendent beyond the cushioning pads 21 as secured on the bifurcated leg member 11 for preventing the hitting obstruction by the cushioning pads 21 of the shock absorbing members 2 when hitting (H) the golf ball 4.

The present invention may be modified without departing from the spirit and scope of the present invention. The present invention may be made as a detachable or breakdown set for easy handling or storage. The present invention may be used for practicing baseball, soft ball, tennis, golf ball, etc.

I claim:

1. A ball practice device comprising:

a base having a plurality of leg members connected each other, each leg member having an end portion thereof secured with a shock absorbing member;

a telescopic post including a lower tube vertically erected on a central portion of said base, and an elbow tube having a vertical tube portion telescopically held on the lower tube and a horizontal tube portion perpendicular to the vertical tube portion of said elbow tube;

a T-shaped connector rotatably mounted on an outer end portion of the horizontal tube portion of the elbow tube;

a ball for hitting practice secured to a first side of said T-shaped connector by a first link; and a counterweight ball having a weight slightly heavier than that of said ball for hitting practice and secured to a second side of said T-shaped connector by a second link, said ball for hitting practice and said counterweight ball vertically linearly aligned to be perpendicular to said horizontal tube portion of said post to allow a rotation of said ball about a horizontal axis defined at a center of said horizontal tube portion of the post, and upon stopping of the rotation of the ball, the counterweight ball will be gravitationally pendent to automatically upwardly restore the ball for hitting practice to an upright position ready for next hitting practice.

2. A ball practice device according to claim 1, wherein said base includes two leg members crossing with each other, said two leg members each having a central portion of each said leg member formed with a hole for passing a bottom male-threaded tube portion of said lower tube of the post and fastened by a nut engageable with the bottom male-threaded portion of the lower tube for securing the leg members at a bottom of said post.

3. A ball practice device according to claim 1, wherein said T-shaped connector includes a horizontal adapter fixed on an outer end portion of the horizontal tube portion of the elbow tube, and a pair of vertical adapters rotatably secured to the horizontal adapter, said pair of vertical adapters respectively connected with said first link and said second link for respectively connecting said ball for hitting practice and said counterweight ball.

4. A ball practice device according to claim 1, wherein said ball for hitting practice is selected from a baseball and a soft ball.

5. A ball practice device according to claim 1, wherein said first link has its outer portion slightly bent outwardly for connecting said ball for practice for hitting a tennis ball for preventing an attack on said link by a racket of tennis.

6. A golf ball practice device comprising:

a base having a plurality of leg members connected each other, each leg member having an end portion thereof secured with a shock absorbing member;

a telescopic post including a lower tube vertically erected on a central portion of said base, and an elbow tube having a vertical tube portion telescopically held on the lower tube and a horizontal tube portion perpendicular to the vertical tube portion of said elbow tube;

a T-shaped connector rotatably mounted on an outer end portion of the horizontal tube portion of the elbow tube;

a golf ball secured to a lower side of said T-shaped connector by a lower link; and a counterweight ball having a weight slightly lighter than that of golf ball and secured to an upper side of said T-shaped connector by an upper link, said golf ball and said counterweight ball verticallly linearly aligned to be perpendicular to said horizontal tube portion of said post for a rotation of said ball about a horizontal axis defined at a center of said horizontal tube portion of the post, and upon stopping of the rotation of the balls, the golf ball will be gravitationally pendent to restore the counterweight ball to an upright position.

7. A ball practice device according to claim 6, wherein said base includes a bifurcated arcuate leg member and a straight elongate leg member for forming a Y-shaped base having the straight elongate leg member secured with a shock absorbing member bigger and heavier than that secured on the bifurcated leg member; said horizontal tube portion of the elbow tube horizontally extended to be projectively protruded beyond the shock absorbing member secured on an end portion of the bifurcated leg member; said golf ball being downwardly pendent from the T-shaped connector to approximate a ground surface to simulate a ball which is placed on a tee for hitting use; and said post secured to said elongate leg member by a reinforcing link.

* * * * *